US008540116B2

(12) United States Patent
Giraud et al.

(10) Patent No.: US 8,540,116 B2
(45) Date of Patent: Sep. 24, 2013

(54) NON-ROUND MOISTURE-TIGHT RE-SEALABLE CONTAINERS WITH ROUND SEALING SURFACES

(75) Inventors: Jean-Pierre Giraud, Paris (FR); Michel Zbirka, Jouy-sur-Morin (FR)

(73) Assignee: CSP Technologies, Inc., Amsterdam, NY (US)

( * ) Notice: Subject to any disclaimer, the term of this patent is extended or adjusted under 35 U.S.C. 154(b) by 0 days.

(21) Appl. No.: 13/344,970

(22) Filed: Jan. 6, 2012

(65) Prior Publication Data

US 2012/0097678 A1 Apr. 26, 2012

Related U.S. Application Data

(60) Division of application No. 12/398,475, filed on Mar. 5, 2009, now Pat. No. 8,100,288, which is a continuation of application No. PCT/US2007/077702, filed on Sep. 6, 2007.

(60) Provisional application No. 60/824,720, filed on Sep. 6, 2006.

(51) Int. Cl.
*B65D 43/14* (2006.01)

(52) U.S. Cl.
USPC ..... 220/835; 220/4.22; 220/231; 220/830; 220/833; 220/844; 220/849; 215/201; 132/294; 206/319; 217/7

(58) Field of Classification Search
USPC ..... 220/4.22, 231, 830, 835, 844, 849; 215/201; 132/294; 206/319; 217/7
See application file for complete search history.

(56) References Cited

U.S. PATENT DOCUMENTS 2,003,355 A 6/1935 Farkas
2,175,673 A 10/1939 Shields (Continued)

FOREIGN PATENT DOCUMENTS

CA 2428862 A1 11/2004
DE 19546684 A1 6/1997

(Continued)

OTHER PUBLICATIONS

PCT Notification of Transmittal of International Search Report and The Written Opinion of the International Searching Authority, in PCT/EP2010/062357, dated Aug. 24, 2010.

(Continued)

*Primary Examiner* — Anthony Stashick
*Assistant Examiner* — Elizabeth Volz
(74) *Attorney, Agent, or Firm* — McAndrews, Held & Malloy, Ltd.

(57) ABSTRACT

A hinged container is disclosed, including a base, a lid, and a hinge joining the base and lid, allowing the lid to pivot open or closed relative to the base. One of the base and the lid has a circular, outwardly tapered outer seal member disposed at least partially within its outer perimeter. The other of the base and the lid has a circular, inwardly-tapered inner seal member disposed at least partially within its outer perimeter. The inner and outer seal members are positioned to engage concentrically to wedge the inwardly and outwardly tapered surfaces together and form a seal when the base and the lid are closed, and to disengage concentrically to part the inwardly and outwardly tapered surfaces when the base and the lid are opened.

15 Claims, 6 Drawing Sheets

(56) References Cited

U.S. PATENT DOCUMENTS

| | | | | |
|---|---|---|---|---|
| 2,258,540 | A | | 10/1941 | Cressaty |
| 2,690,861 | A | | 10/1954 | Tupper |
| 2,814,404 | A | | 11/1957 | Towns |
| 3,227,332 | A | | 1/1966 | Gowdy |
| 3,255,907 | A | | 6/1966 | Eddy |
| 3,272,368 | A | | 9/1966 | Van Baarn |
| 3,441,161 | A | | 4/1969 | Van Baarn |
| 3,784,055 | A | | 1/1974 | Anderson |
| 3,848,780 | A | | 11/1974 | Stull |
| 3,899,097 | A | | 8/1975 | Aichinger |
| 3,967,756 | A | | 7/1976 | Barish |
| 3,986,479 | A | | 10/1976 | Bonk |
| 3,994,417 | A | | 11/1976 | Bodecker |
| 4,036,360 | A | | 7/1977 | Deffeyes |
| 4,043,475 | A | | 8/1977 | Wheeler |
| 4,281,778 | A | | 8/1981 | Stull |
| 4,380,304 | A | | 4/1983 | Anderson |
| 4,730,731 | A | | 3/1988 | Allison |
| 4,746,008 | A | | 5/1988 | Heverly et al. |
| 4,759,463 | A | | 7/1988 | Mazoin |
| 4,778,071 | A | | 10/1988 | Fillmore |
| 4,783,056 | A | | 11/1988 | Abrams |
| 4,807,425 | A | | 2/1989 | Abrams |
| 4,869,387 | A | | 9/1989 | Persson |
| 4,890,742 | A | | 1/1990 | Allison |
| 4,964,539 | A | * | 10/1990 | Mueller ..... 222/94 |
| 5,033,634 | A | | 7/1991 | Batchelor et al. |
| 5,108,029 | A | | 4/1992 | Abrams |
| 5,114,003 | A | | 5/1992 | Jackish |
| 5,133,470 | A | | 7/1992 | Abrams |
| 5,145,646 | A | | 9/1992 | Tyranski |
| 5,379,897 | A | | 1/1995 | Muckenfuchs |
| 5,437,386 | A | | 8/1995 | Von Holdt |
| 5,474,177 | A | | 12/1995 | Abrams |
| 5,542,567 | A | | 8/1996 | Julius |
| 5,553,739 | A | | 9/1996 | Plum et al. |
| 5,667,094 | A | | 9/1997 | Rapchak |
| 5,699,912 | A | | 12/1997 | Ishikawa |
| 5,788,064 | A | | 8/1998 | Sacherer |
| 5,842,486 | A | | 12/1998 | Davis |
| 5,911,937 | A | | 6/1999 | Hekal |
| 6,080,350 | A | | 6/2000 | Hekal |
| 6,092,690 | A | | 7/2000 | Bitowft |
| 6,124,006 | A | | 9/2000 | Hekal |
| 6,130,263 | A | | 10/2000 | Hekal |
| 6,174,952 | B1 | | 1/2001 | Hekal et al. |
| 6,221,446 | B1 | | 4/2001 | Hekal |
| D443,450 | S | | 6/2001 | Ruhotas |
| 6,299,033 | B1 | | 10/2001 | Verweyst |
| 6,303,064 | B1 | | 10/2001 | Abrams et al. |
| RE37,676 | E | | 4/2002 | Abrams et al. |
| 6,364,101 | B1 | | 4/2002 | Schultz |
| 6,394,298 | B1 | | 5/2002 | Zaidman |
| 6,412,634 | B1 | | 7/2002 | Telesca |
| 6,486,261 | B1 | | 11/2002 | Wu et al. |
| 6,613,405 | B1 | | 9/2003 | Hekal |
| 6,769,558 | B1 | | 8/2004 | Bucholtz |
| 6,872,358 | B2 | | 3/2005 | Hagen |
| 6,951,292 | B2 | | 10/2005 | Bando |
| 7,005,459 | B2 | | 2/2006 | Hekal |
| 7,213,720 | B2 | | 5/2007 | Giraud |
| 7,537,137 | B2 | | 5/2009 | Giraud |
| 7,753,228 | B2 | | 7/2010 | Yuhara |
| 2002/0185404 | A1 | | 12/2002 | Donegan |
| 2003/0173325 | A1 | | 9/2003 | Mavin |
| 2004/0173612 | A1 | * | 9/2004 | Giraud ..... 220/259.1 |
| 2005/0258174 | A1 | | 11/2005 | Giraud |
| 2006/0196524 | A1 | | 9/2006 | Yuhara |
| 2007/0023317 | A1 | | 2/2007 | Brozell |
| 2007/0090106 | A1 | | 4/2007 | Yuhara et al. |
| 2009/0200326 | A1 | | 8/2009 | Giraud |
| 2009/0236357 | A1 | | 9/2009 | Giraud |

FOREIGN PATENT DOCUMENTS

| | | | |
|---|---|---|---|
| DE | 29705720 | U1 | 6/1997 |
| EP | 0208413 | A2 | 1/1987 |
| EP | 0328809 | A1 | 8/1989 |
| EP | 0454967 | B1 | 11/1991 |
| EP | 0857665 | A1 | 8/1998 |
| EP | 0916595 | A2 | 5/1999 |
| EP | 1 582 476 | A1 | 10/2005 |
| EP | 1582476 | A1 | 10/2005 |
| EP | 1 595 813 | A1 | 11/2005 |
| EP | 1595813 | A1 | 11/2005 |
| GB | 2205348 | | 12/1988 |
| JP | 7-17748 | | 3/1995 |
| JP | 07-017748 | U | 3/1995 |
| JP | H07 17748 | | 3/1995 |
| JP | 08230920 | A | 9/1996 |
| JP | 08337260 | A | 12/1996 |
| JP | 0912064 | A | 1/1997 |
| JP | 11-180460 | | 7/1999 |
| JP | 2002154594 | A | 5/2002 |
| JP | 2004-299753 | A | 10/2004 |
| JP | 2006-502062 | A | 1/2006 |
| JP | 2006502062 | A | 1/2006 |
| KR | 10-2011-0002347 | A | 1/2011 |
| WO | 91/12181 | A1 | 8/1991 |
| WO | 94/08872 | A1 | 4/1994 |
| WO | WO 94/08872 | A1 | 4/1994 |
| WO | 96/33108 | A1 | 10/1996 |
| WO | WO0046118 | | 8/2000 |
| WO | 01/53058 | A1 | 7/2001 |
| WO | 01/94240 | A1 | 12/2001 |
| WO | 2004/026728 | A1 | 4/2004 |
| WO | WO2004033339 | A1 | 4/2004 |
| WO | 2005/074571 | A2 | 8/2005 |
| WO | WO 2006/045087 | A | 4/2006 |
| WO | 2006/137176 | A1 | 12/2006 |
| WO | WO2008122771 | | 10/2008 |
| WO | WO2008146171 | | 12/2008 |
| WO | WO2008153953 | | 12/2008 |
| WO | WO2008153954 | | 12/2008 |
| WO | W02009/125267 | A1 | 10/2009 |

OTHER PUBLICATIONS

The Patent Office of the People's Republic of China, Notification of First Office Action, in application No. CN200780038497.4, dated Mar. 23, 2010.

Canadian Intellectual Property Office, Office Action in Canadian application No. 2662751, dated Mar. 24, 2011.

International Preliminary Report on Patentability corresponding to International Appln. No. PCT/US2007/077702, mailed Mar. 19, 2009.

European Patent Office, Communication with extended European search report in International application No. 11075189.8-1261 / 2386496 dated Dec. 22, 2011. (8 pages).

Japanese Patent Office, Notice of Reason(s) for Rejection, in Japanese patent application No. 2009-527556, dated Aug. 7, 2012, with translation.

European Search Report for European Patent No. 10155973.0 dated Jul. 8, 2010.

International Search Report and the Written Opinion of the International Searching Authority, or the Declaration, in International application No. PCT/US2012/025813, dated Dec. 6, 2012. (8 pages).

PCT Notification of Transmittal of International Search Report and Written Opinion of the International Searching Authority, in International application No. PCT/EP2010/062357, dated Aug. 24, 2010.

* cited by examiner

NON-ROUND MOISTURE-TIGHT RE-SEALABLE CONTAINERS WITH ROUND SEALING SURFACES

This patent application is a divisional application of U.S. Ser. No. 12/398,475 filed Mar. 5, 2009, now U.S. Pat. No. 8,100,288, which application is a continuation of International Application Serial No. PCT/US2007/077702 (International Publication No. WO 2008/030920), having an International filing date of Sep. 6, 2007 and makes reference to, claims priority to and claims benefit from U.S. provisional patent application Ser. No. 60/824,720 filed on Sep. 6, 2006. Each of these applications is incorporated by reference in its entirety.

CROSS-REFERENCE TO RELATED APPLICATIONS

This application is related to U.S. application Ser. Nos. 11/171,171, filed Jun. 30, 2005; 10/683,311, filed Oct. 10, 2003; and 60/417,533, filed Oct. 10, 2002. Each of these applications is incorporated by reference in its entirety.

BACKGROUND

Background may be found in U.S. Published Application Nos. US2005/0258174 A1 and 2004/0173612. Each of these applications is incorporated herein by reference.

The subject of the invention is a container useful, for example, for the primary bulk packaging of pharmaceutical and medical device products. These pharmaceutical and medical device products degrade in the presence of moisture. Therefore, these products must be packaged in a substantially moisture-free environment throughout the product shelf life.

Consumers prefer bulk package designs that are flat and incorporate innovative, user-friendly shapes (i.e., non-round). These package designs can be conveniently placed in a pocket or purse. When a package shape is non-round, the primary sealing surfaces in the package have also been non-round.

Packages that have non-round sealing surfaces typically incorporate a gasket in the sealing area. The gasket is a compliant material that when compressed, creates a moisture-tight seal in a package sealing region. The gasket, however, is a second material that increases the cost of the overall package. Incorporating a gasket requires two-shot injection molding or a secondary assembly operation.

SUMMARY

The inventor has found that if the sealing surface is substantially or exactly round in shape, a gasket material is not required to create a moisture-tight seal. In some embodiments, this simplifies the mold, the assembly process and the overall cost of the bulk package. In some embodiments, the container and seal elements are made of the same material.

An aspect of the invention is a hinged container including a base, a lid, and a hinge joining the base and lid. The base has an outer perimeter, and so does the lid. The hinge allows the lid to pivot open or closed relative to the base.

The container has an at least substantially circular, outwardly tapered outer seal member that defines a center axis and an at least generally frustoconical surface. The outer seal member is mounted in fixed relation to one of the base and the lid and is exposed at least partially within the corresponding outer perimeter of the base or lid to which it is mounted.

The container has an at least substantially circular, inwardly tapered inner seal member that defines a center axis and an at least generally frustoconical surface. The inner seal member is mounted in fixed relation to the other of the base and the lid, relative to the outer seal member, and is disposed at least partially within the corresponding outer perimeter of the part to which it is mounted.

The inner and outer seal members are positioned to engage concentrically to wedge the inwardly and outwardly tapered surfaces together and form a seal when the base and the lid are closed. The inner and outer seal members are positioned to disengage concentrically to part the inwardly and outwardly tapered surfaces when the base and the lid are opened.

Optionally, the inner and outer seal members are configured to provide a moisture-tight seal.

Optionally, the inner and outer seal members are configured to be resealable.

Optionally, the base and lid perimeters are substantially congruent.

Optionally, the base and lid perimeters are substantially registered when the base and lid are closed.

Optionally, the hinged container is generally clam shell shaped.

Optionally, the hinge is integral with the base and lid.

Optionally, the base has a non-round outer perimeter.

Optionally, the lid has a non-round outer perimeter.

Optionally, the perimeters are registered when the container is closed.

Optionally, any one or more of the lid, the seal member mounted in the lid, the base, the seal member mounted in the base, and the hinge are made of the same material.

Optionally, any one or more of, or all of, the lid, the seal member mounted in the lid, the base, the seal member mounted in the base, and the hinge are made of polypropylene.

Optionally, the hinged container incorporates a child safety feature that makes the container more difficult to open by a young child. In one embodiment the child safety feature includes at least one push tab that protrudes from a notch in the base when in its closed or home position. When the push tab is depressed, it causes a latch mechanism on the child safety feature to clear a catch feature on the lid, thereby allowing the lid to be opened. A spring element associated with the push tab forces the push tab back to its home position.

The present invention enables non-round package shapes by maintaining a round, re-sealable surface between the base and top package components. In some embodiments, a separate gasket material is not required to obtain a moisture-tight seal. In some embodiments, the advantages of a round sealing surface can be provided in a non-round package shape.

BRIEF DESCRIPTION OF DRAWING FIGURES

DETAILED DESCRIPTION

Figure 1:
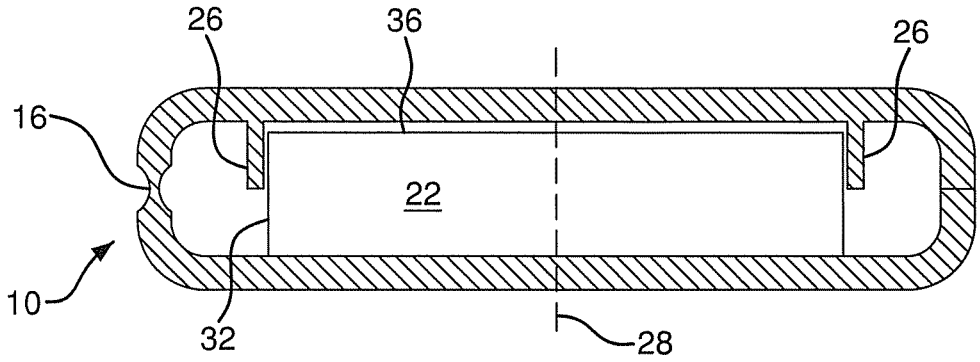
FIG. 1 is a side elevation of a container according to the present invention, with the container base and lid shown in section to illustrate the elements of the seal within the container.
Figure 2:
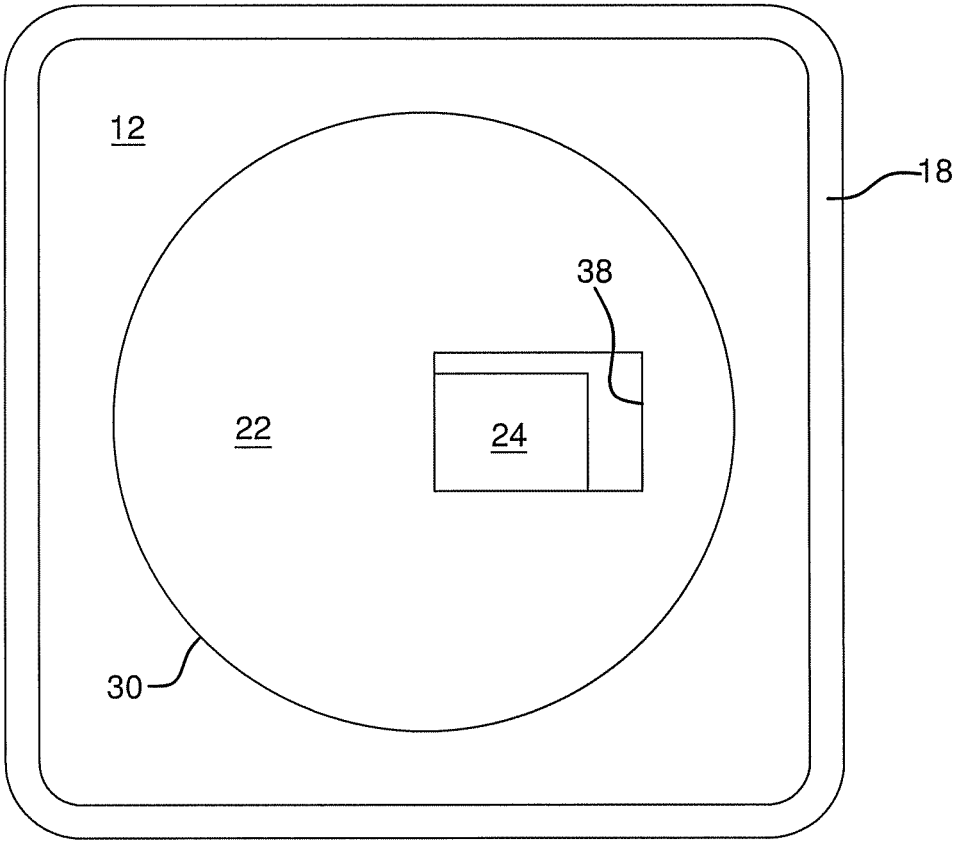
FIG. 2 is a plan view of the base of the container of FIG. 1, with the lid removed.

A typical bulk package of the present invention includes at least two components: (1) a base or first component and a (2) lid or second component. In an embodiment, the base can function as a lid or vice versa. A flip-top hinge may join the two components, forming what is sometimes referred to as a clamshell package or a hinged container assembly. The bulk package is manufactured using an injection molding process. In one embodiment, the lid and base components are composed of polypropylene (PP) or polyethylene (PE). PP and PE are commodity plastic resins that have good moisture barrier properties. Other suitable materials may include, but are not limited to: polyethylene (PE—high density, low density, LLD, VLLD), polypropylene (PP), polyvinyl chloride (PVC), high impact polystyrene (HIPS), cyclic olefin copolymer (CoC) polyethylene vinyl acetate (EVA), polystyrene (PS), polycarbonate (PC), polyester terephthalate (PET), polyamide (nylon), acetal copolymer or homopolymer resin, and liquid crystal polymer. In another embodiment, the base component may incorporate a desiccant plastic material and be composed of a PP or PE exterior surface and a desiccant plastic interior surface.

The product is typically bulk filled into the base component. In one embodiment, a product guide component is assembled on to the filled base component. After product filling, the lid component is closed onto the base component. In one embodiment, the lid component is closed onto the product guide component that is assembled into the base component. During the closing process (i.e., snapping the components together), a moisture-tight seal is created between the lid and base components. In one embodiment, during the closing process, a moisture-tight seal is created between the lid and the product guide component that is assembled into the base component.

The present invention relates to a resealable container, more particularly, an edible film package assembly having an internal sealing mechanism for storing and packaging moisture-sensitive items.

The assembly comprises an upper and lower component that may be attached by a hinge. The upper component has a circular inner skirt or seal partially or completely spaced inward from the outer perimeter. The lower component has a skirt or seal surface partially or completely spaced inward from the outer perimeter. In various embodiments the outer perimeters can be round or non-round, and can optionally be substantially congruent and registered.

In an embodiment, within the lower component is a rectangular feature, referred to as the product tray. The product tray is formed on three sides by vertical walls or stops and on the fourth side by a sloped wall, referred to as the ramp. The compartment created by these walls may be used to hold a stack of edible films.

The circular sealing surface of the lower component includes a wall that engages with the upper lid, providing a tight interference fit between the upper and lower components. In an embodiment, when the package is in the closed position, a moisture-tight seal is created.

In one embodiment, the container may be molded in accordance with the mold(s) similar to that disclosed in U.S. Pat. Nos. 4,783,056 and 4,812,116 respectively. In a further embodiment, with such a process and mold, the assembly, including the cap, container, spring, and hinge may be produced in accordance with the operation disclosed in U.S. Pat. Nos. 4,783,056 and 4,812,116 or, in another embodiment, may be produced in accordance with U.S. Pat. No. 5,723,085 or 6,303,064. The disclosure of these patents are incorporated by reference herein. In these references, the container is closed immediately after molding to create a moisture-tight seal.

In yet another embodiment, a moisture-tight seal may be achieved in the container using a flexible lip feature. The flexible lip seal is disclosed in publication W/O 2005/074571 A3.

In an embodiment a film guide is assembled onto the lower component. The film guide is assembled after product filling. The film guide snaps onto the lower component forming a permanent sealed or unsealed connection with the lower component. The film guide has a circular feature along the top surface which forms a resealable moisture-tight seal with the sealing surface of the upper component.

The overall shape of the bulk package of the present invention is very flexible. The shape may be symmetrical or asymmetrical in nature. Suitable shapes include a square, optionally with rounded corners, a triangle, optionally with rounded corners, an ellipse, a rectangle, optionally with rounded corners, a trapezoid, optionally with rounded corners, and numerous others.

In another embodiment, the present invention relates to a moisture-tight and resealable container and lid assembly. The term "resealable" means that the lid of the container can be opened or reopened and closed or reclosed many times (e.g. more than 10 times) and still retain its moisture-tight properties. As used herein, the terms "moisture-tight" and "moisture-sensitive" mean the moisture ingress of the container (after 1 day) is less than about 1500 micrograms of water, in another embodiment, about 500 micrograms of water, in a further embodiment, about 300 micrograms of water, determined by the following test method: (a) place one gram plus or minus 0.25 grams of molecular sieve in the container and record the weight; (b) assemble the container; (c) place the closed container in an environmental chamber at conditions of 80% relative humidity and 22.2° C.; (d) after one day, weigh the container containing the molecular sieve; (e) after 14 days, weigh the container containing the molecular sieve; and (f) subtract the 14-day sample weight from the initial weight and divide by the number of days (14) to calculate the moisture ingress of the container in units of micrograms of water per day.

In a further embodiment, the container is resealable after repeated lid openings and closings. For example, the seal maintains a low ingression rate after repeated lid openings/closings. In one specific example, the seal maintains its low moisture ingress performance after 50 cycles of lid openings and closings. U.S. Pat. Nos. 4,812,116, 4,807,425, 5,723,085, and 6,769,558 describe examples of embodiments of the sealing arrangement. These references are incorporated herein by reference. In another specific example, a resealable container can be achieved by incorporating a flexible lip seal geometry. The flexible lip seal is disclosed in publication W/O 2005/074571 A3.

In another embodiment a desiccant may be incorporated into the package by making one or more of the package components using a desiccant plastic. In one embodiment the base component of the hinged container has a desiccant plastic interior surface and a PP or PE exterior surface. The base component may be made using a 2-shot injection molding process. In yet another embodiment, the film guide may be made of desiccant plastic.

When the container is repeatedly opened and closed, the desiccant-entrained plastic re-establishes the low relative humidity environment inside the container assembly in a short period of time (e.g. in as low as less than about 10-minutes).

The desiccant-entrained plastic may contain a desiccant such as silica gel or molecular sieve as the desiccant. Depending on the application, such as the application intended by the end user, molecular sieve or silica gel desiccant can be provided in the sleeve. For example, molecular sieve can be used for applications that require a low relative humidity (RH) (e.g. less than <10% RH) maintained over the shelf life. In another example, silica gel can maintain a RH of 10-30% over the product shelf life.

Suitable desiccant entrained plastics include, but are not limited to, the desiccant plastics disclosed in U.S. Pat. Nos. 5,911,937, 6,214,255, 6,130,263, 6,080,350, 6,174,952, 6,124,006, and 6,221,446. These references are incorporated herein by reference. By varying the desiccant loading and polymer types in the formulation, the overall moisture capacity and uptake rate of the desiccant entrained plastic can be controlled.

In a further embodiment the container is provided with a child safety feature that allows the container to be opened relatively easily by an adult, but makes opening the container more difficult for a child. In a preferred aspect of this embodiment, the child safety feature can meet the standards for a Child Resistant Closure (CRC). The U.S. government has established a CR protocol to evaluate the effectiveness of closures. Child Resistant Protocol testing is defined under CFR Title 16, Part 1700 by the Food and Drug Administration. In general, a child resistant closure must be effective with children under 5 years old and be generally user friendly for users over 50 years old, particularly with users over 60 years old.

Referring to FIGS. 1-4, an embodiment of a hinged container 10 is shown including a base 12, a lid 14, and a hinge 16 joining the base and lid. In the illustrated embodiment, the hinged container 10 is generally clam shell shaped, although this is not essential. For example, the hinge 16 could be omitted, or the base 12 and lid 14 could be differently configured. Optionally, the base 12, the lid 14, or both can have a non-round outer perimeter, as shown in the Figures, although the perimeter could instead be round.

The base 12 has an outer perimeter 18, and the lid 14 has an outer perimeter 20. Optionally, the base and lid perimeters 18 and 20 are substantially congruent (have substantially the same shape), and are substantially registered (i.e. the perimeters are substantially aligned with each other all the way around) when the base and lid are closed. Congruence and registration are not, however, required because it is not essential that the base and lid perimeters 18 and 20 meet to form a seal, in the illustrated embodiment. Further, the perimeters 18 and 20 could be congruent but not registered. For example, they could be offset.

The hinge 16 allows the lid 14 to pivot open or closed relative to the base 12. Optionally, the hinge is integral with the base 12 and the lid 14, although it does not need to be integral with the base 12, the lid 14, or either of them. Optionally, a pin hinge or other type of hinge can be used.

A film guide 22 is provided as well to dispense a stack of product sheets 24. The construction, features, and attachment of the film guide are described in more detail later.

Figure 3:
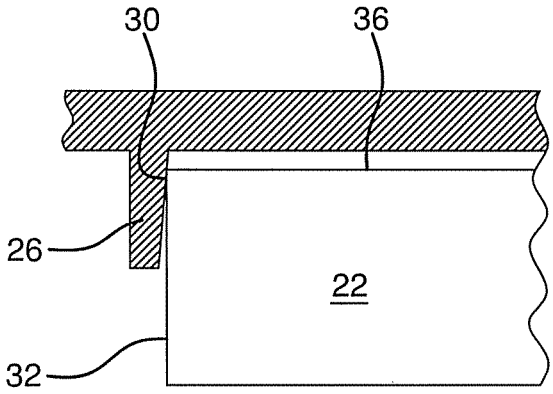
FIG. 3 is a detail view of the seal elements of the container of FIGS. 1 and 2.
Figure 4:
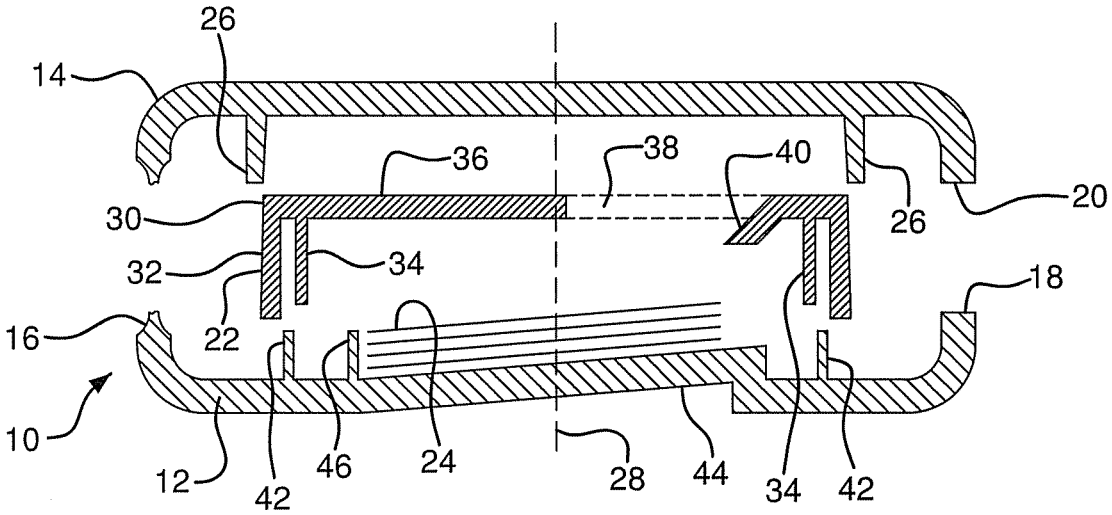
FIG. 4 is an exploded sectional view of the components of the container of FIGS. 1-3.
Figure 5:
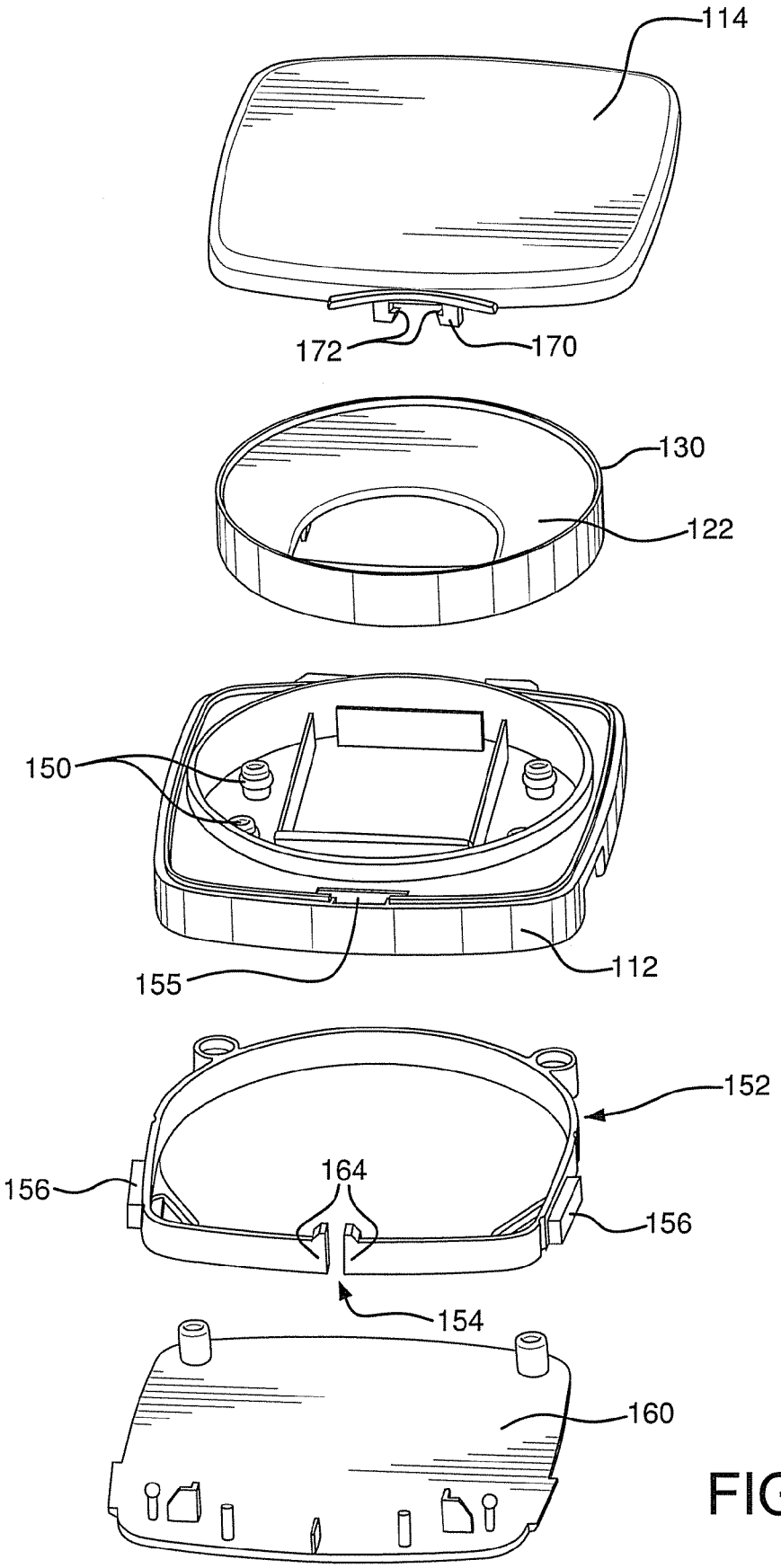
FIG. 5 is an exploded view of the components of an alternative embodiment of the container.

The container 10, and in this embodiment the lid 14, has a circular, outwardly tapered outer seal member 26 that defines a center axis 28. The taper is outward, proceeding vertically down (as shown in FIGS. 3 and 4) to the distal end of the flange forming the outer seal member 26. In other words, the distal end has a larger diameter than a point spaced above the distal end of the flange forming the outer seal member 26.

The outer seal member 26 is mounted in fixed relation to one of the base and the lid (as illustrated, the lid), and is disposed at least partially within the corresponding outer perimeter of the base or lid to which it is mounted. In this embodiment, the outer seal member 26 and the lid 14 are integral, and as illustrated are parts of a single piece of material. Alternatively, they could be separate parts, or could instead be made in a single injection mold with one shot of material.

The container 10, and in this embodiment the base 12, has a circular, inwardly tapered inner seal member 30 that defines a center axis (also 28, as the two axes are collinear in this embodiment when the container is closed). The taper is inward, proceeding vertically up the side wall 32 of the film guide 22 as shown in FIGS. 3 and 4). In other words, the side wall 32 has a smaller diameter at the top corner as shown in FIGS. 1, 3, and 4 than in the seal area beneath the top corner.

The degrees of taper illustrated in the Figures are just examples, and may vary if the materials used are harder, softer, or more or less resilient than polypropylene, or if the dimensions of the seal members are set to make them more or less flexible, or depending on the coefficient of friction between the seal members 26 and 30, among other factors.

The side wall 32 does not need to be tapered from bottom to top, nor does the flange defining the outer seal member 26 need to be tapered from bottom to top. It will suffice if the portions of the inner seal member 30 and the outer seal member 26 that engage each other are tapered, which facilitates wedging them together to form a seal.

The inner seal member 30 is mounted in fixed relation to the other of the base and the lid (here, the base), relative to the outer seal member 26, and is disposed at least partially within the corresponding outer perimeter 18 of the part to which it is mounted. In the illustrated embodiment, the inner seal member 30 is an upper and outer part of the film guide 22, which is a separate part from the base 12. In alternative embodiments, the inner seal member 30 and the base 12 can be integral or made in a single injection mold with one shot of material. Optionally, any one or more of the lid, the seal member mounted in the lid, the base, the seal member mounted in the base, and the hinge are made of the same material. Optionally, they can all be made of the same material, which does not need to be soft enough to form a conventional gasket. Thus, the material can be substantially rigid, not noticeably flexing while the container 10 is normally used. Optionally, any one or more of, or all of, the lid, the seal member mounted in the lid, the base, the seal member mounted in the base, and the hinge can be made of polypropylene.

The inner and outer seal members are positioned to engage concentrically to wedge the inwardly and outwardly tapered surfaces together and form a seal when the base and the lid are closed. The inner and outer seal members 30 and 26 are positioned to disengage concentrically (i.e. with both axes substantially coinciding, as shown in the Figures) to part the inwardly and outwardly tapered surfaces when the base and the lid are opened. The seal or contact length of the inner and outer seal members 30 and 26 from top to bottom is relatively short, so the deviation from concentricity as the lid 14 is pivoted relative to the base 12 is slight. Another expedient is to allow some lateral "play" in the hinge 16 in a direction perpendicular to the axis 28 as the lid 14 is pivoted open, so the lid 14 and base 12 can be kept more nearly concentric while the seal members 26 and 30 are parting. This can be provided in an integral hinge by elongating the narrow cross-section at the fold of the hinge, making the fold of the hinge thinner or weaker, providing a longer, more strap-like integral hinge, or in other ways known in the art.

Optionally, the inner and outer seal members 30 and 26 are configured to provide a moisture-tight seal, as defined in this specification. Optionally, the inner and outer seal members 30 and 26 are configured to be resealable, as defined in this specification.

Return now to the film guide 22. The film guide 22 has a side wall or outer flange 32 and an inner flange 34 (shown in FIG. 4), which in this embodiment is concentric with the outer flange 32, although it does not need to be concentric. The flanges are joined by a circular web 36. The web 36 has a dispensing opening 38 and a depending lip 40.

The base 12 has certain features that cooperate with the film guide 22 to define a dispenser for the stack of sheets 24 within the container 10. The base 12 has a circular flange 42, a re-entrant portion 44 defining a ramp that rises from left to right as shown in FIG. 4, and a stop 46 to confine the product stack 24 to a well-defined location on the ramp. Additional stops (not shown) can be placed on the sides of the stack to further define its location.

FIG. 4 is an exploded view of the container 10, and in particular the film guide 22 is a separate piece, shown raised above its assembled position. When the film guide 22 is lowered into assembled position, its inner and outer flanges 32 and 34 receive the flange 42 of the base 12, and either or both of the flanges 32 and 34 engage the flange 42 to fasten the film guide 22 in position relative to the base 12. It is useful to precisely locate the film guide 22 in a fixed position relative to the base 12, so the inner and outer seal members 30 and 26 will mate properly. The flanges 32, 34, and 42 need to be complementary, but do not need to be round, although they can be round and, if desired, they can define inner and outer sealing members analogous to the inner and outer seal members 30 and 26. This might be useful if an inner sealed container within the outer sealed container is desired, or if the film guide 22 functions as the lid of the container.

Additionally, when the film guide 22 is lowered into assembled position, the angled lip 40 can abut the ramp defined by the re-entrant portion 44, and the stops such as 46 can abut the web 36. This may be useful to prevent sheets from the stack 24 from sliding laterally out of position. In the assembled container, with the lid 14 open, a user can insert a finger through the dispensing opening 38, adhere the top sheet of the stack 24 to the finger, and slide the top sheet up the inclined top surface of the depending lip 40 to dispense the top sheet of the stack. This motion can be repeated to dispense additional sheets. The sheets can be edible, for example, dissolving sheets of a breath freshening compound.

Other dispensing expedients can also be provided. For example, the film guide 22 can be omitted, the flange 42 can extend further to abut the lid 14 when the container 10 is closed, and the flanges 26 and 42 can interact as the inner and outer sealing members, or vice versa. Then a supply of tablets, capsules, a cake of cosmetic powder, cream, or gel, or other items or materials to be dispensed can be contained within the flange 42 and bounded by the webs of the base 12 and lid 14.

Referring to FIGS. 5-9, an alternative embodiment of the container employing a child safety feature is illustrated. In this embodiment, the inner seal member 130 and the outer seal member (not shown) are similar in shape, and function in a similar manner as the inner seal member 30 and the outer seal member 26 illustrated in FIGS. 1-4, to form a seal when the base 112 and the lid 114 are closed. The base 112, however, has alternative features that cooperate with the film guide 122 to fasten the film guide 122 in its fixed position relative to the base 112. These alternative features include a plurality of locating pins 150, for example, four locating pins 150, mounted on the base 112, which fit within corresponding recesses on the lower surface of the film guide when the film guide 122 is lowered into its assembled position on the base 112. The locating pins keep the film guide 122 in a fixed position relative to the base 112.

Figure 8:
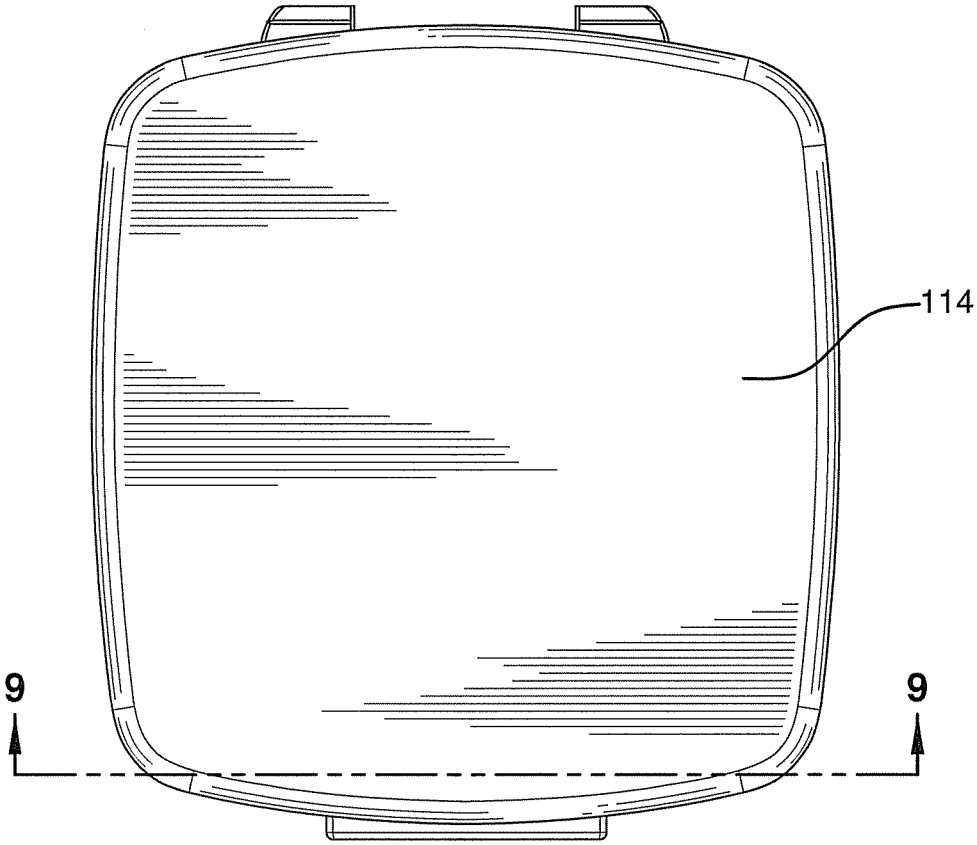
FIG. 8 is a top plan view of the assembled container of FIG. 5 shown with the side tabs of the child safety feature in their depressed position.
Figure 9:
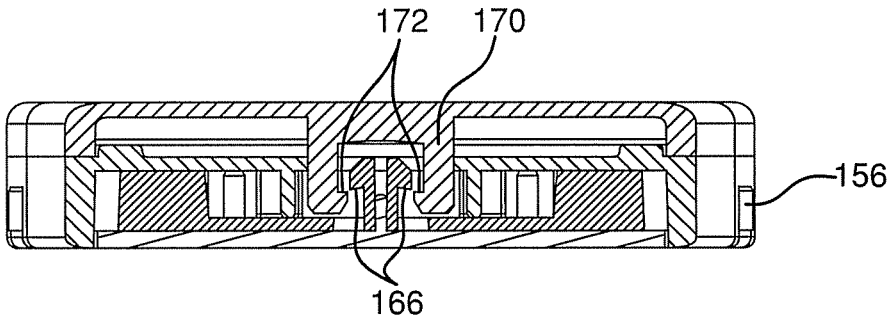
FIG. 9 is a cross sectional view taken along line 9-9 in FIG. 8.

The child safety feature 152 employed in this embodiment is formed from a flexible plastic material and includes a latch mechanism, shown generally at 154, and at least one push tab, here shown as two push tabs 156, one on each side of the child safety feature. The latch mechanism engages a catch feature 170 on the lid 114 to lock the lid to the base 112 when the lid is closed. When the push tabs are depressed, as shown in FIGS. 8 and 9, the latch mechanism is released from the catch to thereby allow the lid to be opened, as will be explained in detail below. Associated with each push tab 156 is a spring 158 which is deflected by the push tab 156 when the push tab is depressed. This action creates a bias in the spring which causes the push tab 156 to return back to its home position when pressure on the push tab is released.

Figure 6:
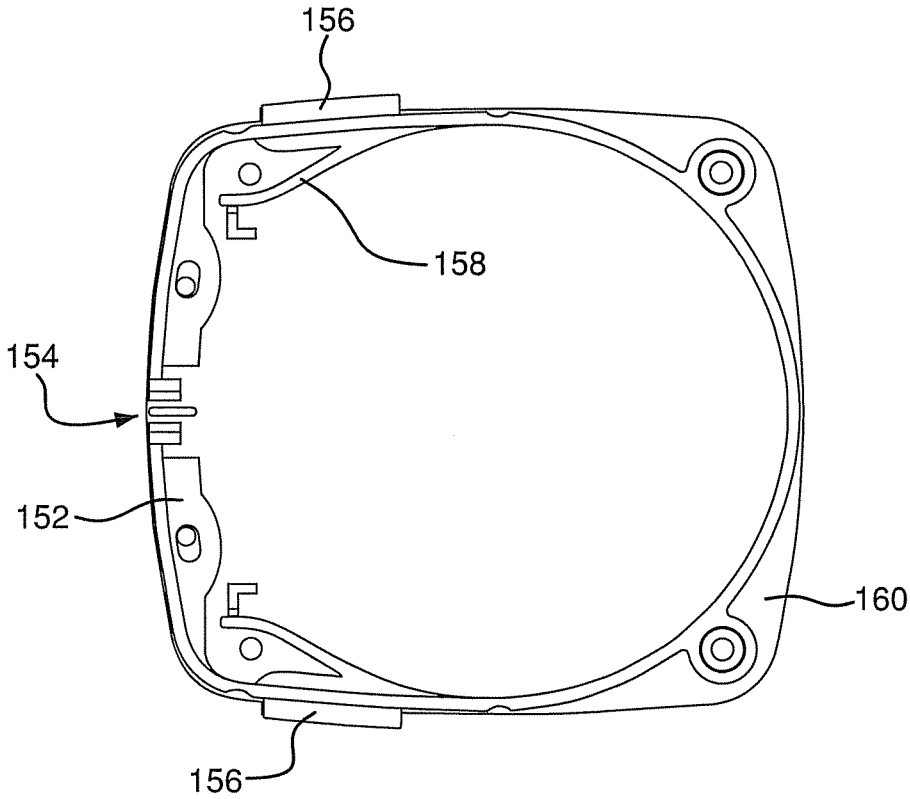
FIG. 6 is a top plan view of the child safety component of the alternative embodiment of FIG. 5.
Figure 7:
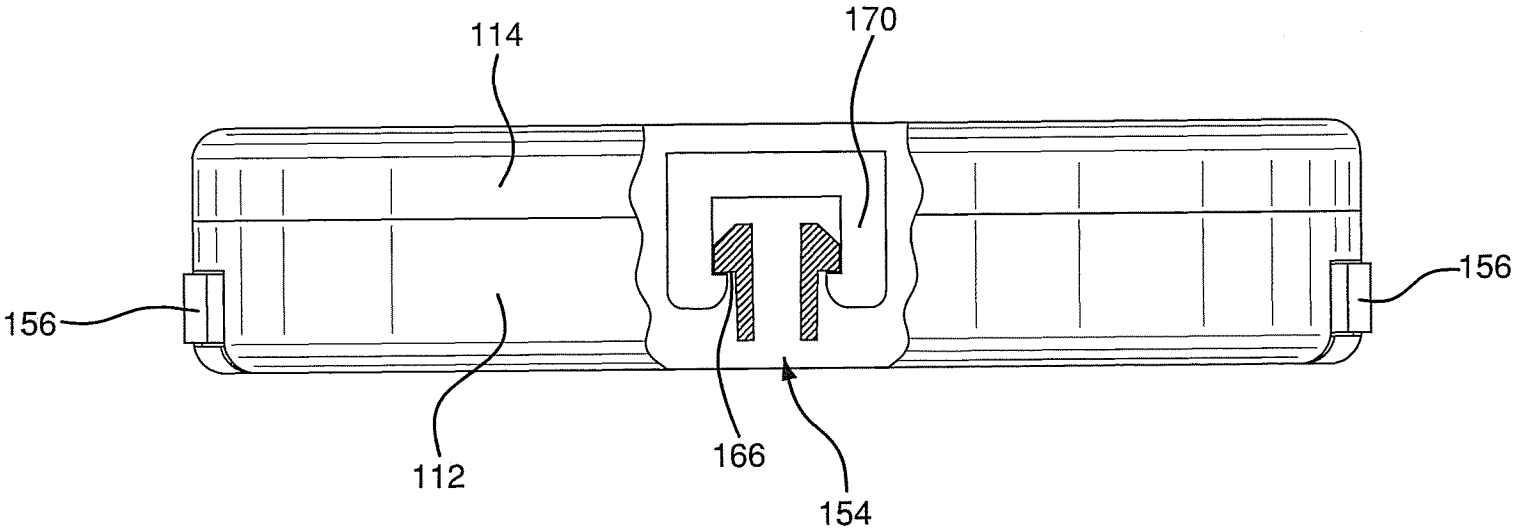
FIG. 7 is a front view of the alternative embodiment of the container as assembled, and cut away to show the latching mechanism of the child safety component.

As illustrated in FIG. 6, the child safety feature 152 can be mounted on a bottom plate 160, which can then be joined to the base 112. Alternatively, the child safety feature could be incorporated into the base 112. The base 112 is provided with a notch 162 on each side of the base to receive each push tab 156 when the child safety feature 152 and bottom plate 160 are assembled to the base 112. When assembled, the push tabs 156 project outwardly from the sidewalls of the base 112 through the notches 162.

The latch mechanism 154 projects through an opening 155 in the base 112 and includes at least one latch portion 164 (here shown as two latch portions 164) having a downward facing abutment 166. In this instance, "downward" means facing away from the direction in which the lid 114 opens, and not necessarily referring to the orientation of the container relative to its surroundings. Each latch portion 164 engages a catch 170 (here shown as two catches 170) that extends downwardly from the lid 114. Each catch has an upward facing abutment 172 that receives the downward facing abutment 166 of the latch portion 164 when the lid 114 is in its closed position on the base 112 to lock the lid 114 onto the base 112. In this instance "upward" means facing in the direction in which the lid 114 opens, and not necessarily referring to the orientation of the container relative to its surroundings.

To unlock the lid 114 and open the container, a user depresses the push tabs 156 inward toward the container. This action causes each downward facing abutment 166 on each latch portion 164 to move away from the upward facing abutment 172 on each catch 170 so that the latch portion 164 clears the catch 170. Once the latch portion clears the catch, the lid 114 can be opened. Releasing pressure on the push tabs 156 enables each spring 158 to force each push tab back to its outwardly projecting home position.

Although the child safety feature is illustrated as being joined to the base, it is contemplated that the child safety feature could be incorporated into the lid. In such an embodiment, the latch mechanism could be located on the lid while the catch feature could be located on the base. Further, although the child safety feature is shown incorporated into a container that is relatively flat, it is contemplated that the child safety feature could be incorporated into a container of virtually any shape, as long as the container employed a base, a lid, and a hinge joining the lid to the base.

The foregoing description is illustrative of many contemplated embodiments of the invention, and does not limit the scope of the invention as defined by the claims.

The invention claimed is:

1. A hinged container comprising:

(a) a base having an outer perimeter;

(b) a lid having an outer perimeter;

(c) a hinge joining the base and lid, allowing the lid to pivot open or closed relative to the base;

(d) a circular, outwardly tapered outer seal member defining a center axis and mounted in fixed relation to one of the base and the lid and disposed at least partially within the corresponding outer perimeter;

(e) a circular, inwardly-tapered inner seal member defining a center axis and mounted in fixed relation to the other of the base and the lid and disposed at least partially within the corresponding outer perimeter;

(f) the inner and outer seal members being positioned to engage concentrically to wedge the inwardly and outwardly tapered surfaces together and form a seal when the base and the lid are closed, and to disengage concentrically to part the inwardly and outwardly tapered surfaces when the base and the lid are opened;

wherein the base is provided with a latch portion, the lid is provided with a catch, and the latch portion is positioned to engage the catch when the lid and the base are closed; the hinged container further comprising at least one push tab in association with the latch portion, whereby when the push tab is depressed, the latch portion is released from the catch.

2. The hinged container of claim 1, in which the inner and outer seal members are configured to provide a moisture-tight seal.

3. The hinged container of claim 1, in which the inner and outer seal members are configured to be resealable.

4. The hinged container of claim 1, in which the base and lid perimeters are substantially congruent.

5. The hinged container of claim 1, in which the base and lid perimeters are substantially registered when the base and lid are closed.

6. The hinged container of claim 1, which is generally clam shell shaped.

7. The hinged container of claim 1, in which the hinge is integral with the base and lid.

8. The hinged container of claim 1, in which the base and/or the lid has a non-round outer perimeter.

9. The hinged container of claim 1, further comprising a spring in association with the push tab wherein the spring returns the push tab from its depressed position.

10. The hinged container of claim 1, in which the latch portion has an abutment that engages an abutment on the catch when the lid and the base are closed.

11. The hinged container of claim 1, in which a film guide is mounted in the base.

12. The hinged container of claim 11, in which the film guide comprises a desiccant entrained polymer.

13. The hinged container of claim 1, in which at least one of (a) the lid and the seal member mounted in the lid, (b) the base and the seal member mounted in the base, (c) the lid and the hinge, and (d) the base and the hinge, are made of the same material.

14. The hinged container of claim 13, in which the base is made of 2 materials and one of the materials is a desiccant entrained polymer.

15. The hinged container of claim 13, in which at least one of the lid, the seal member mounted in the lid, the base, the seal member mounted in the base, and the hinge is made of polypropylene.

* * * * *